United States Patent [19]

Clark et al.

[11] Patent Number: 4,640,335

[45] Date of Patent: Feb. 3, 1987

[54] CASTING APPARATUS

[75] Inventors: Peter J. Clark, Cannock; Anthony W. Hudd; Stephen T. Bloor, both of Sutton Coldfield, all of England; Erling Roller, Essen, Fed. Rep. of Germany

[73] Assignee: IMI Refiners Ltd., Walsall, England

[21] Appl. No.: 692,543

[22] Filed: Jan. 18, 1985

[30] Foreign Application Priority Data

Jan. 25, 1984 [GB] United Kingdom ..... 8401976

[51] Int. Cl.[4] ..... B22D 11/10

[52] U.S. Cl. ..... 164/440; 164/490

[58] Field of Search ..... 164/440, 490

[56] References Cited

U.S. PATENT DOCUMENTS

| | | | |
|---|---|---|---|
| 3,076,241 | 2/1963 | Simonson et al. | 164/440 X |
| 3,530,926 | 9/1970 | Wertli | 164/490 X |
| 3,987,840 | 10/1976 | Birat | 164/490 X |

*Primary Examiner*—Kuang Y. Lin

*Attorney, Agent, or Firm*—Cushman, Darby & Cushman

[57] ABSTRACT

Horizontal casting apparatus which includes a composite sleeve or ring at the entrance to the mould comprising a graphite inner portion and an insulating outer portion. The apparatus can optionally have an inert gas shield around the composite ring to protect the graphite component thereof against oxidation.

9 Claims, 1 Drawing Figure

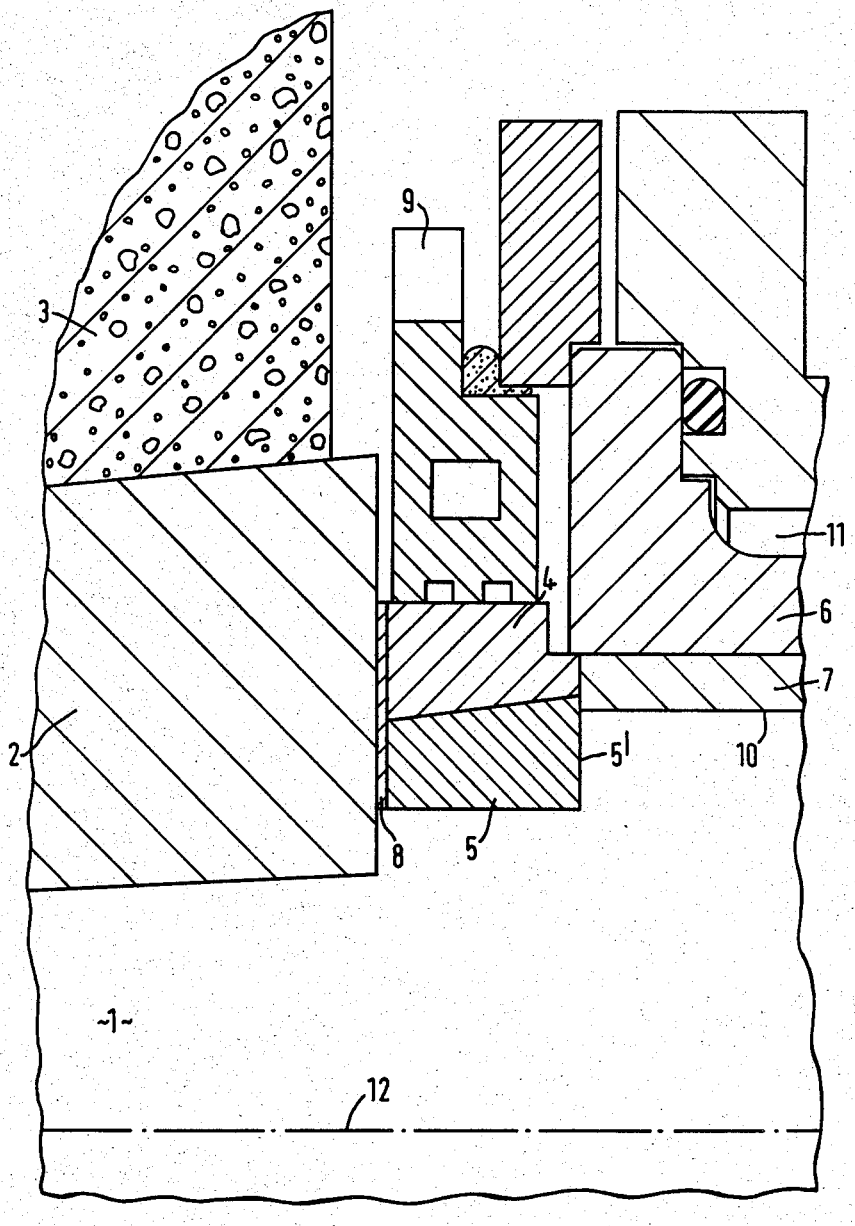
9
3
11
4
6
7
2
5'
10
8
5
1
12

CASTING APPARATUS

BACKGROUND OF THE INVENTION

This invention relates to apparatus suitable for use in the continuous casting of metals, especially copper, and more particularly to such apparatus in which the casting occurs in a horizontal plane.

In general, a continuous casting process relates to one in which molten metal stored in a container, usually referred to as a tundish, is allowed to flow at a predetermined rate through a tubular or other cavity in a mould in which solidification of the metal occurs.

In the case of many metals, it is critical that a variety of process parameters are correctly controlled, including the composition and nature of the mould surface on which the metal solidifies, the rate of flow of metal, the temperature at different parts of the casting apparatus and in particular the temperature gradient across critical parts of the apparatus. In the case of copper in particular, there can be problems in achieving the desired properties in the cast metal. It has generally been found that graphite is an excellent mould surface material in that newly solidified metal can slide readily over its surface and not adhere thereto without the need for lubricants. It is also known that casting in a horizontal plane is beneficial in certain respects although this can in itself present problems in controlling the various process parameters.

The present invention is concerned with the provision of novel apparatus for use in the horizontal continuous casting of metals, the use of which generally overcomes problems previously associated with such apparatus.

SUMMARY OF THE INVENTION

In accordance with the invention there is provided apparatus for the continuous casting of metals which includes a horizontally oriented mould, means for cooling the mould, feed means through which molten metal can pass from a container towards the mould, and means intermediate the feed means and the mould comprising a composite sleeve having an inner portion which contacts the metal to be cast and an outer portion which is made from an insulating material, the cross section of the sleeve aperture adjacent the mould entrance being smaller than that of the mould so that the sleeve inner portion forms a shoulder immediately adjacent the mould entrance.

The apparatus of the invention is especially suitable for the continuous casting of copper. It allows for:

(i) The mould and related components to reciprocate to prevent the solidifying metal adhering to the mould surface.

(ii) control of the temperature gradient in the apparatus so that the molten metal is kept sufficiently hot to prevent solidification until it enters the mould but ensures solidification of at least a thin crust or shell on the outer surface of the metal immediately it does enter the mould.

(iii) the provision of a shoulder immediately adjacent the mould entrance substantially next to which the solidifying crust or shell of metal is formed.

(iv) the use of a chosen mould surface material, especially graphite, not only on the surface of the mould itself but also on the surface of the shoulder.

A critical component of the apparatus is the composite sleeve. Typically, although not necessarily, the sleeve will have a circular cross-section and will have a relatively short length and can therefore be regarded as a ring-shaped component. The cross-sectional shape of this sleeve or ring will generally be of the same shape as that of the mould and will in general be fixed in contact with an end of the mould with the respective longitudinal axes parallel and aligned so that the sleeve forms a substantially uniform shoulder around the end of the mould.

Graphite is a preferred material for the mould surface and the same material can usefully be employed for the inner portion of the composite sleeve or ring. The thickness of this inner portion must, however, be sufficiently large to ensure that only the inner portion, and not the outer portion, forms the shoulder. Graphite is not a good insulator and to ensure that the molten metal remains sufficiently hot until it enters the mould, the outer portion of the composite sleeve or ring must be made from a good insulating material having adequate mechanical strength, and, in addition, the inner and outer portion must be held in close contact with each other.

Use of this composite sleeve or ring therefore ensures that a chosen material such as graphite can be used to contact the metal to be cast in the mould itself and in the immediate vicinity of the mould whilst ensuring that the insulating portion of the composite sleeve or ring keeps the metal from solidifying prematurely.

Preferably, the inner portion of the sleeve or ring will be as thin as possible commensurate with its providing the shoulder and maintaining its integrity. Most preferably, to ensure optimum insulation, the cross-section of the inner portion tapers on the side adjacent the insulating outer portion and becomes smaller in a direction away from the shoulder so that the cross-section of the inner portion is, for example, trapezoidal in shape. It has also been found that such a trapezoidal (or similar) shape can be beneficial in ensuring a tight fit or force fit between the two portions of the sleeve or ring which is essential to aid insulation.

The cooling of the mould is by conventional means. Generally the graphite (or whatever) surface lining of the mould is surrounded by a copper (or other conductive metal) jacket around which are channels through which cooling fluid, normally water, passes. The graphite surface is usually tapered to some extent so that the cross section of the mould interior is smaller at the outlet than at the inlet to take account of the contraction of the solidifying metal in the mould.

Graphite is readily oxidisable at the temperatures encountered in the casting process and such oxidation, especially at the critical region of the interface between the composite sleeve and the mould entrance in the vicinity of the shoulder, can detrimentally affect the quality of the metal being cast. In preferred embodiments of the invention, means are therefore provided to protect the composite sleeve or ring and the mould interface surface from the atmosphere. This can be effected by providing a nitrogen or other inert gas shield about the relevant parts of the apparatus; the inert gas can usefully be passed through passageways formed adjacent these parts.

DESCRIPTION OF THE PREFERRED EMBODIMENTS

To illustrate the invention, reference is made by way of example only, to the accompanying drawing which shows part of a casting apparatus of the invention.

With reference to the drawing, the casting apparatus comprises feed means generally designated 1 having an insulating ceramic feed tube 2 and surrounded by refractory concrete 3, a composite circular ring having an outer portion 4 made from an insulating ceramic within which is force-fitted an inner portion 5 made from graphite, and a mould having a copper jacket 6 within which is tightly fitted a mould lining 7 made from graphite.

The tube 2 and the composite ring 4/5 are rigidly held in contact with each other by means not shown and a seal between them is provided by an insulating gasket 8. The ring 4/5 is shrink-fitted within a steel carrier ring 9 and is also rigidly held in contact with the mould and in particular with the graphite mould lining 7 by means not specifically shown. The inner portion 5 thereby forms a shoulder 5' immediately adjacent the mould surface 10. The mould surface 10 tapers so that its cross section is greater at the upstream end. Cooling water passes through channels 11 in those parts of the mould surrounding the copper jacket 6.

The whole of the apparatus shown in the drawing can be reciprocated, for example by an amount of 1 to 2 mm, in the direction of the longitudinal axis of the mould, i.e. along the centre line 12.

In operation of the apparatus, molten copper is fed from a tundish into the feed tube 2 and hence into the space within the ring 4/5; during this time, the metal remains molten because of the heat insulating properties of the feed tube 2 and the composite ring 4/5. The metal then passes into the mould and the cooled mould surface 10 causes a thin crust or shell of metal to solidify in the vicinity of the shoulder 5'. This shell becomes thicker as it travels along the mould and fully solidified metal is withdrawn from the mould outlet on a continuous basis. The mould taper takes account of the shrinkage of the metal during solidification and cooling and ensures close contact between the metal being cast and the mould surface 10.

We claim:

1. Apparatus for the continuous casting of metal, comprising:

a horizontally-oriented mould having in inner perimetrically-extending mould surface extending longitudinally from a mould entrance end;

said mould including means for cooling said mould surface so as to cause molten metal to solidify thereagainst while travelling longitudinally of said mould from said mould entrance end;

a feed means adapted to pass molten metal from a container towards said entrance end of said mould for supplying said mould with molten metal;

a perimetrically-extending composite sleeve sealingly interposed axially between said feed means and said mould at said entrance end of said mould so that molten metal flowing from said feed means into said mould through said entrance end of said mould, must flow through said composite sleeve;

said composite sleeve including a perimetrically-extending inner portion made of graphite and having a perimetrically-extending inner surface defining at least part of a conduit between said feed means and said mould;

said composite sleeve further including a perimetrically-extending outer portion engagingly surrounding said inner portion, said outer portion being made of thermal insulating material;

said inner portion of said composite sleeve, immediately adjacent said entrance end of said mould, about all of the periphery of said inner surface of such composite sleeve inner portion, being of such lesser transverse extent from a notional longitudinal centerline of said mould surface, that an abrupt, downstream-facing annular shoulder is formed on said inner portion of said composite sleeve, which annular shoulder extends effectively between said inner surface of said inner portion of said composite sleeve, and said mould surface at said entrance end of said mould.

2. The apparatus of claim 1, wherein:

said composite sleeve is axially short and therefore is ring-shaped.

3. The apparatus of claim 1, wherein:

on axially opposite sides of said shoulder, said inner surface of said mould and said inner surface of said inner portion of said composite sleeve are of like transverse cross-sectional figure, and are both centered on said notional longitudinal centerline, so that said shoulder is substantially uniform in radial extent perimetrically thereof.

4. The apparatus of claim 1, wherein:

said inner portion of said composite sleeve gradually increases in transverse cross-sectional area as it extends longitudinally towards said shoulder, at least primarily by increasing in external dimension radially of said notional longitudinal centerline.

5. The apparatus of claim 4, wherein:

said inner portion of said composite sleeve is of trapezoidal longitudinal cross-sectional figure, with said shoulder providing the larger of two bases to such trapezoidal figure.

6. A composite sleeve for interposition axially between:

(a) an entrance end of a horizontally-oriented mould having an inner perimetrically-extending mould surface extending longitudinally from such mould entrance end, which mould includes means for cooling said mould surface so as to cause molten metal to solidify thereagainst while travelling longitudinally of said mould from said mould entrance end; and (b) a feed means adapted to pass molten metal from a container towards said entrance end of said mould for supplying said mould with molten metal, so that molten metal flowing from said feed means into said mould through said entrance end of said mold, must flow through said composite sleeve, said composite sleeve comprising:

a perimetrically-extending inner portion made of graphite and having a perimetrically extending inner surface for defining at least part of a conduit between said feed means and said mould;

a perimetrically-extending outer portion engagingly surrounding said inner portion, said outer portion being made of thermal insulating material;

said inner portion of said composite sleeve, for placement immediately adjacent said entrance end of said mould, about all of the periphery of said inner surface of such composite sleeve inner portion, being of such lesser transverse extent from a notional longitudinal centerline of said mould surface, that, when said composite sleeve is so interposed, an abrupt, downstream-facing annular shoulder is formed on said inner portion of said composite sleeve, which annular shoulder is adapted to extend effectively between said inner surface of said inner portion of said composite sleeve, and said mould surface at said entrance end of said mould.

7. The composite sleeve of claim 6, wherein:

said composite sleeve is axially short and therefore is ring-shaped.

8. The composite sleeve of claim 6, wherein:

said inner portion of said composite sleeve gradually increases in transverse cross-sectional area as it extends longitudinally towards said shoulder, at least primarily by increasing in external dimension radially of said notional longitudinal centerline.

9. The composite sleeve of claim 8, wherein:

said inner portion of said composite sleeve is of trapezoidal longitudinal cross-sectional figure, with said shoulder providing the larger of two bases to such trapezoidal figure.

* * * * *